United States Patent [19]

Kelm et al.

[11] Patent Number: 4,679,400

[45] Date of Patent: Jul. 14, 1987

[54] VARIABLE TURBINE VANE SUPPORT

[75] Inventors: James S. Kelm, Milford; Harvey M. Maclin; Edward C. Vickers, both of Cincinnati; Thomas G. Wakeman, West Chester, all of Ohio

[73] Assignee: General Electric Company, Cincinnati, Ohio

[21] Appl. No.: 754,678

[22] Filed: Jul. 12, 1985

Related U.S. Application Data

[63] Continuation-in-part of Ser. No. 561,756, Dec. 15, 1983, abandoned.

[51] Int. Cl.[4] ..... F02C 1/00

[52] U.S. Cl. ..... 60/722; 60/39.75; 415/137; 415/138

[58] Field of Search ..... 415/136, 137, 138, 139, 415/160, 161, 162, 115; 60/39.75, 7.22

[56] References Cited

U.S. PATENT DOCUMENTS

| | | | |
|---|---|---|---|
| 2,852,914 | 9/1958 | Robin et al. | 60/39.31 |
| 2,994,509 | 8/1961 | Walker | 415/159 |
| 3,043,564 | 7/1962 | Small, Jr. | 415/137 |
| 3,224,194 | 12/1965 | Feo et al. | 415/160 X |
| 3,443,791 | 5/1969 | Sevetz et al. | 415/115 |
| 3,500,639 | 3/1970 | Stamm | 60/39.31 |
| 3,588,269 | 6/1971 | Wall, Jr. | 415/161 |
| 3,663,118 | 5/1972 | Johnson | 415/116 |
| 3,904,309 | 9/1975 | Keetley | 415/160 X |
| 3,959,966 | 6/1976 | Pearce et al. | 415/139 X |
| 3,965,066 | 6/1976 | Sterman et al. | 415/138 X |
| 4,213,738 | 7/1980 | Williams | 416/95 |

*Primary Examiner*—Carlton R. Croyle
*Assistant Examiner*—Timothy S. Thorpe
*Attorney, Agent, or Firm*—Douglas S. Foote; Steven J. Rosen; Derek P. Lawrence

[57] ABSTRACT

Means for axially attaching a variable turbine vane array to a combustor in a gas turbine engine is disclosed. The attachment means are configured so that substantially all of the axial load on the array is transmitted through the walls of the combustor.

8 Claims, 4 Drawing Figures

VARIABLE TURBINE VANE SUPPORT

The Government has rights in this invention pursuant to Contract F33615-78-C-2007 awarded by the Department of the Air Force.

This is a continuation-in-part of application Ser. No. 561,756, filed Dec. 15, 1983 now abandoned.

This invention relates generally to turbine engines, and more particularly, to means for supporting variable turbine vanes on such engines.

BACKGROUND OF THE INVENTION

Gas turbine engines generally include a coumbustion chamber for generating a gas flow. Turbine blades connected to a rotor are located aft of the combustor and within the gas flowpath so as to extract useful energy from the gas flow. In order to optimize the amount of energy extracted, an array of vanes is typically interposed between combustor and turbine blades to turn the gas stream. By imparting a circumferential component to the flow, higher turbine blade speeds are attainable.

In many gas turbine engines, it is desirable to rotate the vanes to control the gas flow between the vanes. For example, in aircraft engine applications, power requirements may differ depending on the flight condition. Consequently, an array of fully variable turbine vanes may be advantageously employed. However, to be fully effective, any variable turbine array must be mounted so as to minimize leakage of the gas from the designated flowpath and around the airfoil.

In a typical engine containing an annular combustor, an annular casing with inner and outer casing walls surrounds the combustor. The casing defines a flowpath between the combustor and casing for air to cool the walls of the combustor. The casing extends beyond the aft end of the combustor and provides the structure to which the vane array may be attached. For example, U.S. Pat. No. 3,663,118—Johnson shows such a mounting arrangement.

The problem with using the outer and inner casing walls for support is that they exhibit differential rates of thermal growth due to the inner casing wall being from 200° to 300° hotter than the outer casing wall. Thus, the inner wall exhibits greater axial movement due to thermal expansion than the outer wall. This may stress seals thereby creating gas flow leakage paths. Futhermore, the turbine vane might bind on the surrounding shroud as their axes become misaligned.

An alternative to mounting the vane array on inner and outer casing walls is to mount it solely on the outer wall in a cantilever arrangement. A floating seal would be provided near the vane root to prevent leakage. The problem with this solution is that it requires an unduly large structure to counteract the bending stress on the vanes induced by the gas flow. Moreover, due to the differential temperature discussed above, a larger than normal radial gap must be provided to assure non-binding at all conditions. These gaps are controlled by floating seals which have the potential to leak relatively large quantities of gas.

OBJECTS OF THE INVENTION

It is an object of the present invention to provide a new and improved support for a variable turbine vane array.

It is another object of the present invention to provide new and improved means for preventing gas flow leakage around a variable turbine vane array.

It is a further object of the present invention to provide a new and improved means for preventing binding of a variable turbine vane array.

It is yet another object of the present invention to provide a new and improved means of attaching a variable vane array to a combustor.

SUMMARY OF THE INVENTION

One form of the present invention comprises axial attachment means for attaching a variable turbine vane array to a combustor in a gas turbine engine. The array is located aft of the combustor which has inner and outer combustor walls. The axial attachment means are configured so that substantially all of the axial load on the array is transmitted through the combustor walls.

DETAILED DESCRIPTION OF THE INVENTION

Figure 1:
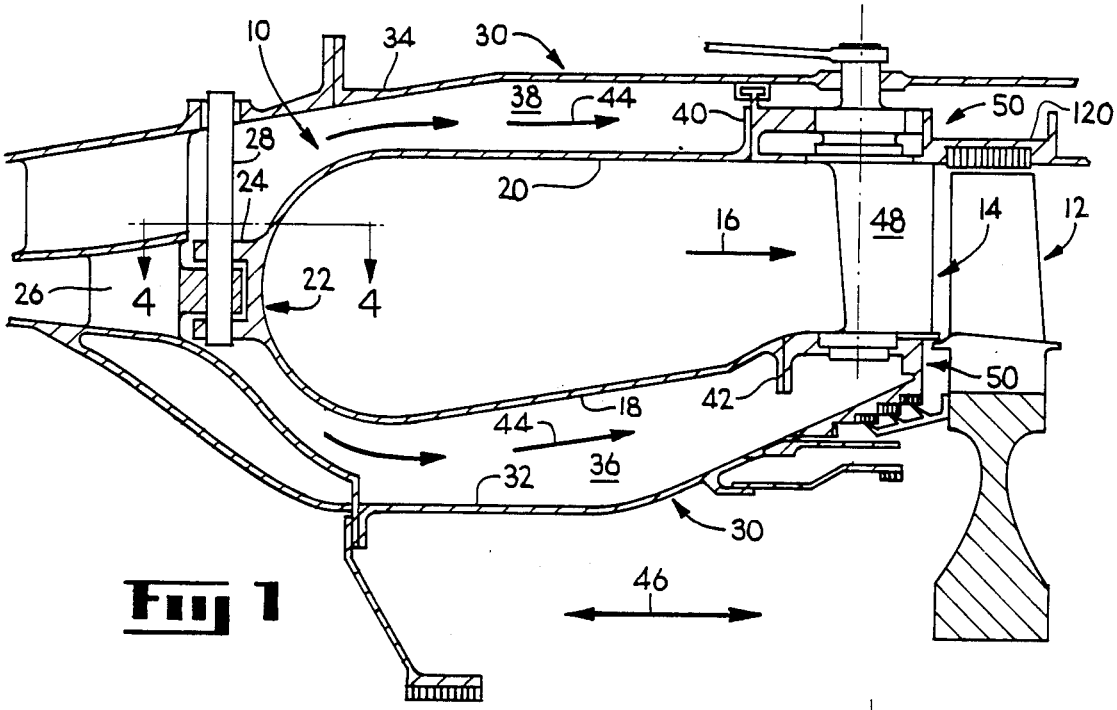
FIG. 1 is a cross-sectional view of a combustor and a variable turbine vane array attached thereto according to one form of the present invention.

FIG. 1 shows a view of an annular combustor 10, variable turbine vane array 14, and turbine wheel 12 in a turbine engine according to one form of the invention. In operation, air and fuel are burned within combustor 10 to generate a high velocity gas stream 16. Gas stream 16 is turned to impart a circumferential component to its direction as it passes through vane array 14. Therefore, a rearward axial force and a circumferential force is imparted to the turbine vane array. This axial force is then transmitted to the combustor walls 18 and 20. Gas stream 16 then impacts on turbine wheel 12 which extracts energy by rotating in reaction to the force of the flow.

Combustor 10 includes inner combustor wall 18 and outer combustor wall 20. As shown, walls 18 and 20 are single thickness; however, it is within the scope of the present invention to include multiple thickness walls. For example, various liner configurations on the inside of supporting walls are frequently used thereby creating a double walled combustor.

Located on the forward end 22 of combustor 10 are a plurality of clevises 24. These are connectable to frame member 26 by means of pins 28. Each pin 28 may be adapted to mate with clevis 24 so that forward axial contact and circumferential clearance between pin 28 and clevis 24 occurs. This allows axial loads through combustor walls 18 and 20 to be transmitted to casing 30 while preventing such transmission of circumferential loads. For ease of installation, each pin 28 extends beyond outer casing wall 34. Combustor 10 is thereby supported for axial loads. Many alternate means for providing forward axial support for combustor 10 will occur to those skilled in the art. It will be clear that the present invention is not limited to the particular form described and illustrated above.

Annular combustor 10 is surrounded by annular casing 30. Casing 30 includes inner casing wall 32 and outer casing wall 34. These walls 32 and 34 bound combustor 10 and form therebetween inner cooling flow channel 36 and outer cooling flow channel 38.

Connected to the aft end of outer combustor wall 20 is an outer flange 40. In the configuration shown in FIG. 1, flange 40 extends radially outward from wall 20. Similarly, connected to the aft end of inner combustor wall 18 is an inner flange 42. As shown, inner flange 42 extends radially inward from wall 18.

During engine operation, outer combustor wall 20 and inner combustor wall 18 are subjected to high temperatures from the heat generated inside combustor 10. In order to cool walls 18 and 20, air 44 is directed through flow channels 36 and 38. Some of this air might also pass through holes in walls 18 and 20 to provide further cooling. Because of the effect of radiation and the surrounding temperature, inner casing wall 32 tends to run several hundred degrees hotter than outer casing wall 34. By comparison, while combustor walls 18 and 20 are hotter than casing walls 32 and 34, combustor walls 18 and 20 are generally maintained at the same temperature.

The different temperatures of casing walls 32 and 34 means that they will expand and contract at different rates. This differential is a particular problem in the axial direction 46 when a variable vane array is attached to these walls. In contrast, differential expansion/contraction is not significant in the circumferential direction because annular members generally expand circumferentially along a radial line, thereby maintaining their orientation when heated.

Variable turbine vane array 14 includes a plurality of vanes 48. Vane array 14 is supported by support means 50. Support means 50 includes axial attachment means for attaching vane array 14 to combustor walls 18 and 20 so that substantially all the axial load on array 14 due to gas stream 16 is transmitted through combustor walls 18 and 20. In addition, suppport means 50 includes circumferential restraint means for transmitting circumferential loads from vane array 14 to casing 30. Support means 50 with axial attachment means and circumferential restraint means are shown in more detail in FIG. 2.

Figure 2:
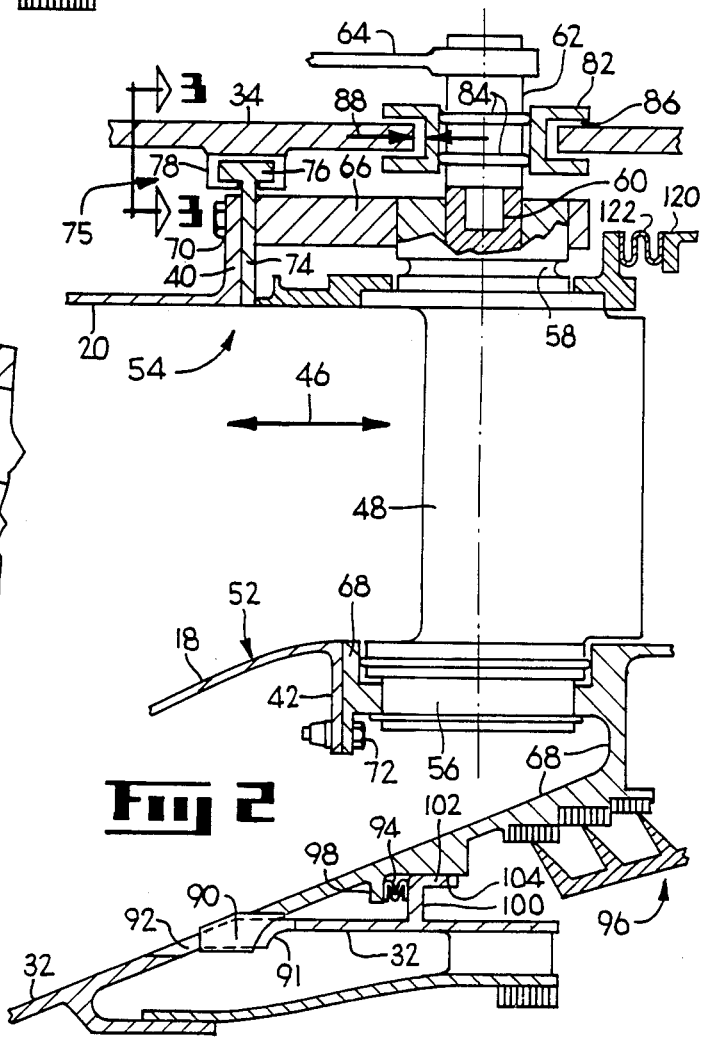
FIG. 2 is a cross-sectional view in greater detail of the variable turbine vane array shown in FIG. 1.
Figure 4:
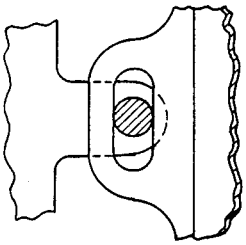
FIG. 4 is a view taken along the line 4—4 in FIG. 1.

FIG. 2 shows a specific embodiment of the present invention including a vane 48 with inner support means 52 and outer support means 54. Vane 48 has root 56 and outer shank 58. Outer shank 58 has a mortise 60 at its radially outer end which is adapted to receive tenon 62 which is connected to actuator arm 64. Rotational movement of arm 64 thereby rotates vane 48. By connecting all arms 64 to a common ring (not shown), the entire vane array 14 may be actuated simultaneously.

Axial attachment means, in the embodiment of FIG. 2, include outer and inner flanges 40 and 42, outer and inner support structures 66 and 68, and fastening means 70 and 72. Outer support structure 66 has a radially directed circular hole therethrough which mates with outer shank 58 of vane 48. Similarly, inner support structure 68 has a radially directed circular hole therethrough which mates with root 56 of vane 48. Vane 48 is free to rotate in these holes, but is positioned both axially and circumferentially therein. Numerous configurations of support structures 66 and 68 are possible. In one embodiment, inner structure 68 may be a continuous 360° ring while outer structure 66 may be segmented to facilitate assembly.

Outer support structure 66 is connected to outer flange 40 by fastening means 70, shown in the embodiment of FIG. 2 as bolts. Similarly, inner support structure 68 is connected to inner flange 42 by fastening means 72, shown as bolts.

From the above description, it is clear that the axial load on vane array 14 will be transmitted through support structures 66 and 68 and into combustor walls 20 and 18. To ensure that substantially all of the axial load on array 14 is so transmitted, several other features of the invention are described as follows. Coaxially disposed about tenon 62 is bushing 82. Bearing means 84 allow tenon 62 to rotate freely within bushing 82. A circumferential slot 86 in bushing 82 receives outer casing wall 34. Clearance 88 is provided so that wall 34 is free to move axially within slot 86 as wall 34 thermally expands and contracts. Consequently, axial loads in vane 48 will not be transmitted to casing wall 34. In a somewhat analogous manner, axial loads are not transmitted through actuator arm 64. This may be achieved by providing a slideable pin and yoke arrangement where arm 64 connects to the common actuator ring (not shown).

Figure 3:
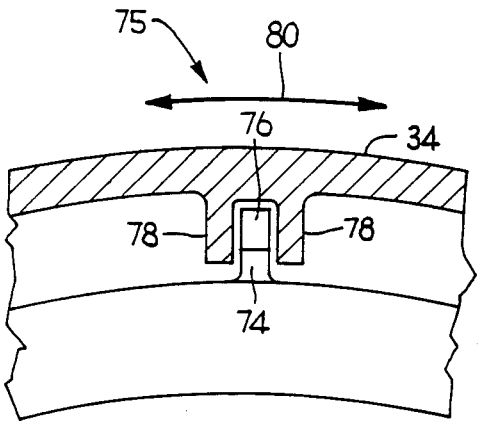
FIG. 3 is a view taken along the line 3—3 in FIG. 2.

Circumferential support for vane array 14 is provided by circumferential restraint means 75. Restraint means 75 include a 360° ring 74 attached to outer support structure 66 and a plurality of outer lugs 76 extending outwardly from ring 74. Restraint means 75 further include a plurality of yokes 78 extending inwardly from outer casing wall 34. As shown in an axial view in FIG. 3, each yoke 78 receives a lug 76. Yoke 78 is adapted to provide restraint in the circumferential direction 80, but allows axial movement of outer casing wall 34 relative to outer lugs 76.

Circumferential restraint means 75 for inner support structure 68 include a plurality of inner lugs 90 extending radially inward from inner support structure 68, and a plurality of axial slots 92 in inner casing wall 32. Each slot 92 is adapted to receive one of the inner lugs 90. Thus, as with yoke 78, axial slot 92 provides circumferential restraint while allowing axial movement of inner casing wall 32 relative to inner lug 90. It may be desirable to provide a yoke-like flange 91 to inner support structure 68 and disposed about slot 92 to provide further circumferential restraint.

To prevent leakage of air which may pass through slot 92, sealing means 94 and 96 are provided. For example, sealing means 94 may be a "w" type seal between an inner flange 98 of inner support structure 68 and an outer flange 100 of inner casing 32. Seal means 96 may be a conventional rotating seal. Any leakage past "w" seal 94 is confronted by rotating seal 96. Thus, seal 96 provides redundancy for seal 94.

As described above, vane array 14 is supported both axially and circumferentially. Radial positioning or concentricity is provided by annular ledge 104 of inner support structure 68 resting on annular lip 102 of flange 100. Ledge 104 is coaxial with lip 102 and makes radial contact therewith. However, ledge 104 is free to move axially relative to inner casing wall 32. By such radial positioning, concentricity between vane array 14 and turbine wheel 12 may be maintained.

It will be clear to those skilled in the art that the present invention is not limited to the specific embodiment described and illustrated herein. Rather, it applies equally to any combustor and vane array with mounting means adapted to transmit axial loading on the array to the combustor walls. It will be understood that the dimensions and proportional and structural relationships shown in the drawings are by way of example and these illustrations are not to be taken as the actual dimensions or proportional structural relationships used in the variable turbine vane support of the present invention.

Numerous modifications, variations, and full and partial equivalents can be undertaken without departing from the invention as limited only by the spirit and scope of the appended claims.

What is desired to be secured by Letters Patent of the United States is the following.

What is claimed is:

1. In a gas turbine engine including an annular combustor with inner and outer combustor walls, an annular casing with inner and outer casing walls bounding said combustor, and a variable vane array with a plurality of vanes located aft of said combustor, the improvement comprising:

support means for supporting said variable turbine vane array including axial attachment means for attaching said array to said combustor wall so that substantially all of the axial load on said array is transmitted through said combustor walls.

2. Support means, as recited in claim 1, further comprising:

circumferential restraint means for transmitting substantially all of the circumferential load on said array to said casing.

3. Support means, as recited in claim 2, wherein said axial attachment means comprise:

an outer flange connected to said outer combustor wall;

an inner flange connected to said inner combustor wall;

outer and inner support structures for positioning each of said vanes, wherein each of said vanes is rotatable in said structures; and fastening means for connecting said outer and inner structures to said outer and inner flanges respectively;

thereby transmitting substantially all of the axial load on said array through said support structures, flanges, and combustor walls.

4. Support means, as recited in claim 3, wherein said circumferential restraint means comprise:

a plurality of outer lugs extending outwardly from said outer structure; and a plurality of yokes extending inwardly from said outer casing wall adapted to provide circumferential restraint and allow axial movement of said outer casing wall relative to said outer lug.

5. Support means, as recited in claim 3, wherein said circumferential restraint means comprise:

a plurality of inner lugs extending inwardly from said inner support structure; and a plurality of axial slots in said inner casing wall, each adapted to receive one of said inner lugs thereby providing circumferential restraint and allowing axial movement of said inner casing wall relative to said inner lugs.

6. In a gas turbine engine including an annular combustor with inner and outer combustor walls, an annular casing with inner and outer casing walls bounding said combustor, a variable vane array with a plurality of vanes located aft of said combustor, and a turbine wheel located aft of said array, support means for supporting said variable turbine vane array comprising:

axial attachment means for attaching said array to said combustor wall so that substantially all of the axial load on said array is transmitted through said combustor walls; and radial positioning means for maintaining concentricity between said vane array and said turbine wheel.

7. Support means, as recited in claim 6, wherein said radial positioning means comprise:

an annular ledge connected to said array; and an annular lip connected to said inner casing wall; wherein said ledge is coaxial with said lip and makes radial contact therewith.

8. In a gas turbine engine, the combination comprising:

an annular combustor with inner and outer combustor walls;

an annular casing with inner and outer casing walls bounding said combustor; and a variable vane array located aft of said combustor;

wherein said array is attached to said combustor walls so that substantially all of the axial load on said array is transmitted through said combustor walls; and wherein said array is restrained by said casing walls so that substantially all of the circumferential load on said array is transmitted to said casing.

* * * * *